United States Patent [19]

Riley

[11] Patent Number: 4,489,911

[45] Date of Patent: Dec. 25, 1984

[54] LADDER-MOUNTABLE DEVICE

[76] Inventor: Jack Riley, 30 Sandy Vale, Haywards Heath, West Sussex, England

[21] Appl. No.: 468,142

[22] Filed: Feb. 22, 1983

[51] Int. Cl.[3] ..... E06C 7/14

[52] U.S. Cl. ..... 248/238; 182/121; 182/129

[58] Field of Search ..... 182/129, 121, 122, 214; 248/210, 211, 238

[56] References Cited

U.S. PATENT DOCUMENTS

| | | | |
|---|---|---|---|
| 3,459,277 | 8/1969 | Frederick | 182/214 |
| 3,495,683 | 2/1970 | Broden | 248/210 |
| 3,822,846 | 7/1974 | Jesionowski | 248/210 |
| 3,829,051 | 8/1974 | Emmons | 248/238 |
| 4,099,693 | 7/1978 | Blann | 248/210 |

FOREIGN PATENT DOCUMENTS

| | | | |
|---|---|---|---|
| 1260476 | 1/1972 | United Kingdom | 182/214 |
| 2034795 | 6/1980 | United Kingdom | 248/238 |

*Primary Examiner*—Reinaldo P. Machado

[57] ABSTRACT

A device capable of being mounted on a ladder having hollow rungs comprises a platform or tray having a first arm mounted thereon adjacent one end thereof and a second arm pivotably mounted thereon adjacent the other end thereof and extending below the platform or tray, said second arm being adjustable in length and said arms being adapted to enter the hollow rungs of a ladder. In use the first and second arms are inserted in separate rungs of the ladder, the second arm being inserted in the rung below the first arm.

10 Claims, 4 Drawing Figures

LADDER-MOUNTABLE DEVICE

This invention relates to a device capable of being mounted on a ladder having hollow rungs, so as to provide a substantially horizontal platform or tray for, for example, paint or tools.

Many workers who use ladders, such as builders and decorators, require a considerable amount of tools and materials in their work. It is common practice for such workers to carry their tools and materials in their pockets or to hang containers, such as old paint tins, from the ladder. It is clearly dangerous to carry sharp tools in the pockets of clothing and containers hung from the rungs of a ladder obstruct the free use of the ladder.

A number of attempts have been made to solve this problem. U.S. Pat. No. 3,784,139 discloses a paint can support in which a support member is inserted in a hollow rung of the ladder and wedged in place by means of a rung-engaging block which is drawn over a ramp on the support member by means of a threaded rod to engage the interior of the rung. Positioning of the paint can support is thus dependant on frictional engagement between the support member and block on one hand and the interior of the rung on the other hand. It is clear that such an arrangement will not provide a stable support when used with ladders having rungs of widely varying shapes and sizes.

U.S. Pat. No. 3,822,846 discloses a similar device. A support member within a hollow rung is wedged in place by means of a cranked rod riding over a cam on the underside of the support member. Again, such a device can only function at all in rungs of a limited range of size and shape. Even within this range there is a clear risk of accidental dislodgement of the cranked rod.

Finally U.S. Pat. No. 4,099,693 shows a device for supporting a paint can which, whilst having the advantage of simplicity, can only suspend the can below the rung in which it is inserted and thus cannot support a horizontal platform for tools and equipment, or a paint tray for use with a roller.

It is an object of the invention to provide a ladder-mountable device for carrying tools, etc., which may be safely and securely positioned close to the ladder without obstructing it.

According to the invention, there is provided a device capable of being mounted on a ladder having hollow rungs, the device comprising a platform or tray having a first arm mounted thereon adjacent one end thereof and a second arm pivotably mounted thereon adjacent the other end thereof and extending below the platform or tray, said second arm being adjustable in length and said arms being adapted to enter the hollow rungs of a ladder.

In use the first and second arms are inserted in separate rungs of the ladder, the second arm being inserted in a lower rung than the first arm.

The length of the second arm can then be adjusted so that the platform or tray is substantially horizontal, regardless of the inclination of the ladder or the spacing between the rungs, and the platform or tray is thus mounted securely at one side of the ladder.

In one preferred embodiment, the first arm has removeable stop means mounted thereon, the stop means being incapable of passing through the hollow rung of a ladder. After the first arm has been passed through the hollow rung from the side of the ladder on which the platform or tray is mounted, the stop means is secured thereto, so that the device is prevented from being dislodged from the ladder by means of said stop means, and the device can only be removed from the ladder by removing the stop means. In the preferred embodiment, the stop means comprises a threaded member received on a threaded portion of the first arm.

In a further preferred embodiment, the free end of the first arm is provided with means for securing the arm to the ladder, for example a length of cord.

The first arm preferably extends horizontally from the tray and the second arm includes a portion extending below the tray and pivoted thereto at its upper end, its lower end being L-shaped so as to include a horizontal portion free to enter the hollow rung of a ladder. Preferably, the second arm comprises two members which are slidable with respect to one another, whereby the length of the second arm between its horizontal portion and the platform or tray is continuously adjustable. This can be achieved by making the two members telescopic, that is one is slidably received in the other. Alternatively, one member can simply be mounted slidably on the other by an arrangement which allows the one member to move along the other member and to be perpendicular thereto.

The orientation of the platform or tray relative to the ladder can be fixed by either locking the second member so that it is unable to pivot relative to the tray or by locking the second arm so that its length is fixed. In one preferred embodiment, the second arm comprises two members, one being pivotally mounted on the platform or tray and the other having said horizontal portion, which are slidable with respect to one another and the arm is lockable by preventing said sliding movement. This may be achieved, for example, by means of a screw-threaded member provided on one of said members and engageable with the other of said members. Alternatively, the one member may be carried on the other member via a releasable clamping arrangement, including a wing nut, for example.

The member of the second arm mounted on the platform or tray is preferably substantially L-shaped, so as to have a horizontal portion which extends below the platform or tray and is pivotably held below the platform or tray by at least one U-shaped bracket, for example. Alternatively, the member could be pivotally mounted on one side of the platform or tray.

Figure 1:
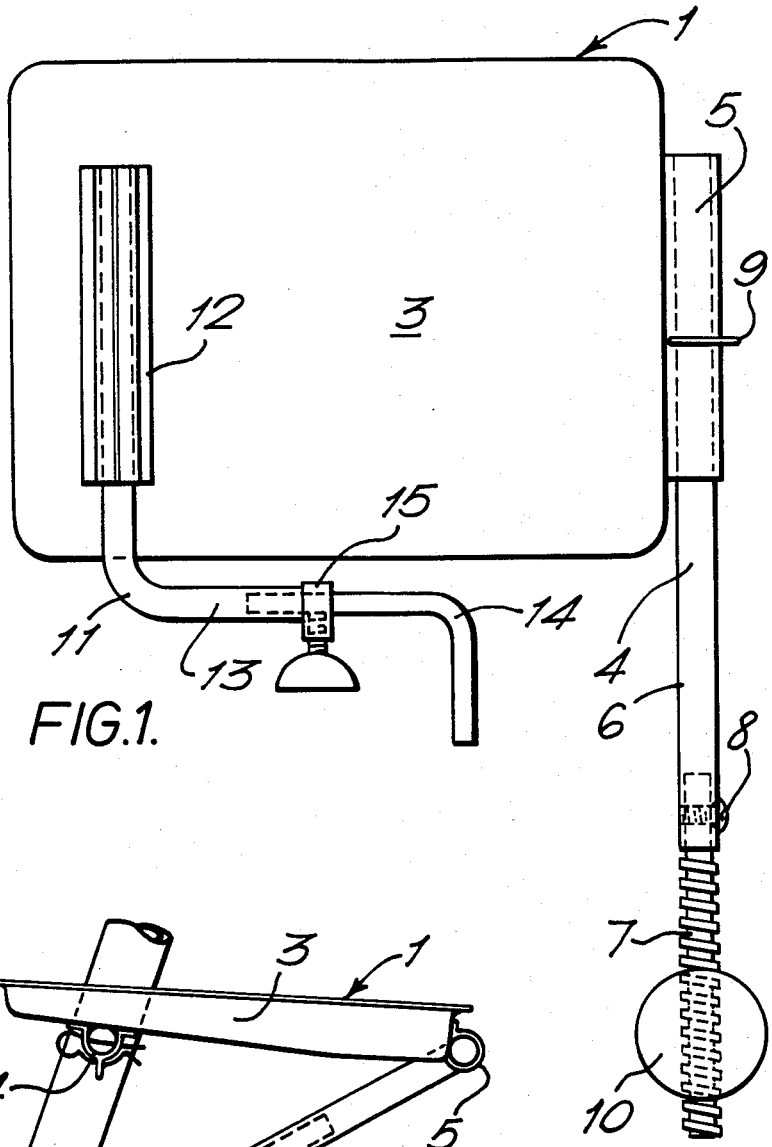
FIG. 1 is bottom plan view of a preferred embodiment of a device according to the invention.

As shown in FIGS. 1 to 4, a device in accordance with the present invention and indicated generally at 1 may be mounted on a ladder 2 having hollow rungs in such a manner that a tray 3 forming part of the device 1 is substantially horizontal. Whilst the tray 3 is shown in the form of a conventional paint tray for use with a roller, other forms of tray or a simple planar platform could alternatively be provided. Adjacent one end of the tray 3, an arm 4 is mounted on the underside of the tray by means of a U-shaped bracket 5. The arm 4 comprises a tubular member 6 having a threaded member 7 made, for example, of nylon, secured to one end thereof by means of a screw 8. The tubular member 6 is secured to the bracket 5 by means of a spring clip 9 which passes through apertures in the member 6 and the bracket 5. Stop means in the form of a threaded knob 10 made, for example, of nylon, is received on the threaded member 7.

A telescopic cranked arm 11 is pivotably mounted on the tray 3 adjacent the other end thereof by means of a U-shaped bracket 12. The arm 11 comprises an outer, substantially L-shaped member 13 and an inner, substantially L-shaped member 14 slidable in the outer member 13. The inner member 14 may be fixed in position relative to the outer member 13 by means of a screw-threaded clamp 15 provided on the outer member 13. As the screw of the clamp is tightened, the free end of the screw engages the member 14 to prevent sliding movement thereof relative to the outer member 13. Whilst the arm 11 may be secured to the bracket 12 by means of a clip analogous to the clip 9, such a clip is not essential for the stable mounting of the device on a ladder.

Figure 2:
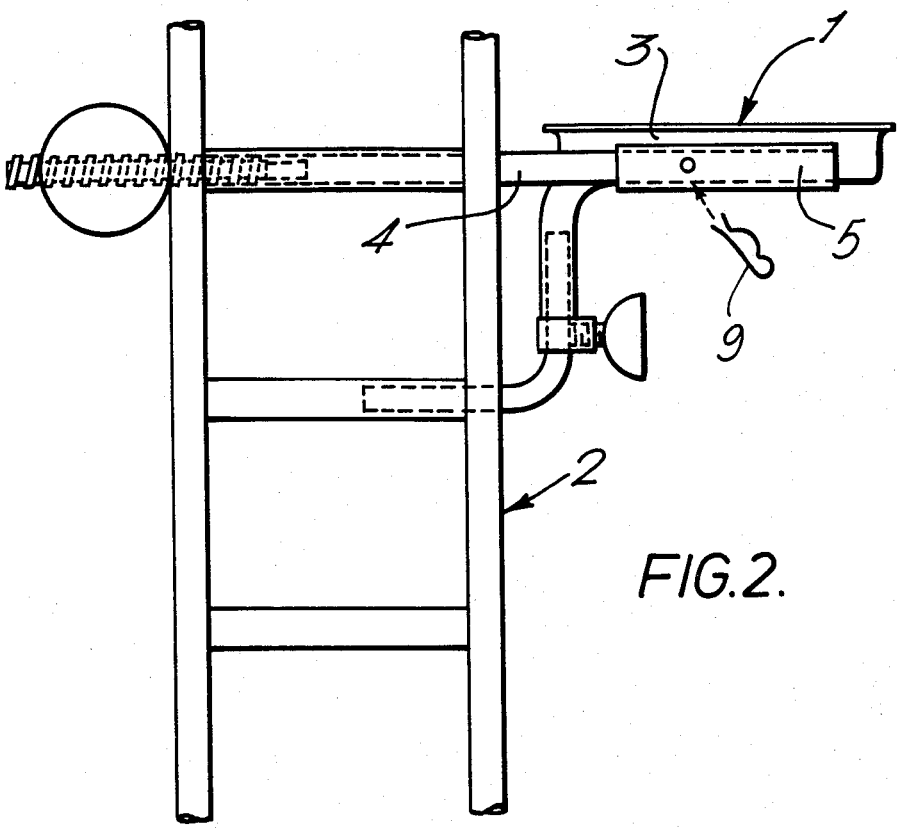
FIG. 2 is a front view of the device shown in FIG. 1, mounted on a ladder.

In order to mount the device on a ladder, the threaded knob 10 is removed from the first arm 4. The arm 4 is then passed through a hollow rung of a ladder until further movement of the member 7 in the leftward direction as shown in FIG. 2 is prevented by engagement of one side of the tray 3 with one of the stiles of the ladder. At the same time, the free end of the cranked telescopic arm 11 is introduced into the open end of a lower rung of the ladder. The knob 10 is then replaced on the threaded member 7 and screwed up to engage the other stile of the ladder. The tray 3 can now be brought into a horizontal position by adjusting the length of the telescopic arm 11. When the arm is the desired length and the tray is horizontal, the clamp 15 is tightened. The device is then firmly secured to the ladder, and cannot be dislodged without first removing the knob 10 which allows the tray to be removed from the ladder by sliding the arm 4 out of a first hollow rung of the ladder and withdrawing the free end of the L-shaped member 14 from a second hollow rung of the ladder.

Figure 4:
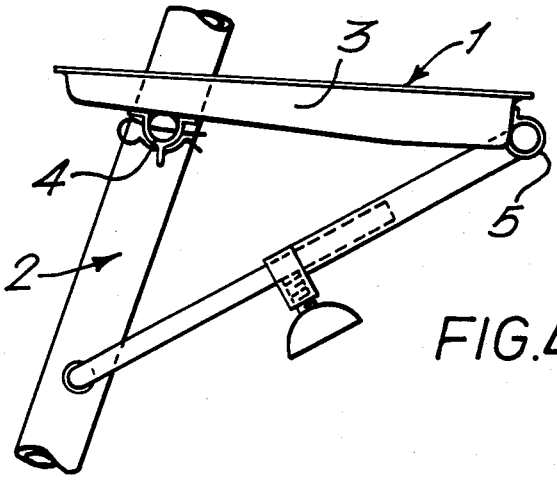
FIG. 4 is an elevation of the device shown in FIGS. 1 to 3, mounted on a ladder in a second orientation.
Figure 3:
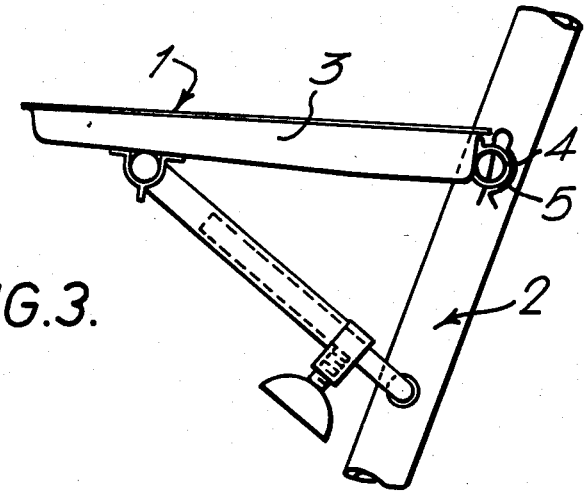
FIG. 3 is an elevation of the device shown in FIGS. 1 and 2, mounted on a ladder in a first orientation.

When the device is assembled in the manner shown in FIGS. 1 to 3, with the first arm 4 secured in the bracket 5 and the second arm 11 positioned in the bracket 12, the tray 3 extends forwardly of the ladder 2, as shown in FIG. 3. Alternatively, the arm 11 can be inserted in the bracket 5 and the arm 4 can be secured to the bracket 12 by means of the clip 9, as shown in FIG. 4. In this configuration, the tray extends rearwardly of the ladder.

There is thus provided a simple device which can be rapidly mounted on a ladder to provide a secure, substantially horizontal tray or platform for paint or tools, which does not obstruct the ladder, and which substantially improves the safety of a worker on the ladder.

I claim:

1. A support device for installation on a ladder having hollow rungs, said support device comprising:

tray means, said tray means defining a plane;

first bracket means affixed to said tray means adjacent a first end thereof;

elongated support arm means, a first end of said support arm means being captured in said first bracket means, said support arm means extending outwardly from said tray means and being positioned by said bracket means so that at least a first portion thereof is parallel to said plane, said first portion of said support arm means having a size and shape which permits said arm means first portion to be received in a hollow ladder rung, said first portion of said support arm means having a length sufficient to permit said support arm means first portion to extend completely through a ladder rung whereby the second end of said support arm means will project outwardly from a first side of a ladder, said tray means thus being disposed on the opposite side of the ladder, at least a section of said support arm means first portion which projects outwardly from the first side of the ladder being externally threaded;

securing means, said securing means engaging said externally threaded section of said support arm means, said securing means being larger in at least one dimension than the inner diameter of the ladder rungs whereby said securing means prevents withdrawal of said support arm means from the ladder rung;

second bracket means, said bracket means being affixed to said tray means at a point displaced from said first bracket means; and leveling arm means, said leveling arm means including a first rigid member which is engaged at a first end thereof by said second bracket means and a second rigid member which is sized and shaped at a first end thereof to be received in a ladder rung which is disposed beneath the rung through which said support arm means first portion extends, said first and second members being releasably joined together, the effective length of said leveling arm means being adjustable by imparting relative movement to said members to thereby vary the point at which they are joined, said leveling arm means further comprising means for locking said first and second members to one another at said point.

2. The apparatus of claim 1 wherein at least one of said leveling arm means members is generally L-shaped.

3. The apparatus of claim 2 wherein said leveling arm means members are in part coaxial and telescoping.

4. The apparatus of claim 2 wherein said leveling arm means first member is pivotal in said second bracket means.

5. The apparatus of claim 3 wherein both of said leveling arm means members are generally L-shaped.

6. The apparatus of claim 2 wherein said support arm means is comprised of a first tubular member, said first tubular member being engaged by said first bracket means, said support arm means further comprising an externally threaded rod, said rod being coaxial with and secured in the end of said tubular member disposed away from said first bracket means, said rod defining said support arm means first portion.

7. The apparatus of claim 6 wherein at least one of said leveling arm means members is generally L-shaped.

8. The apparatus of claim 7 wherein said leveling arm means first member is pivotal in said second bracket means.

9. The apparatus of claim 8 wherein both of said leveling arm means members are generally L-shaped.

10. The apparatus of claim 9 wherein said leveling arm means members are in part coaxial and telescoping.

* * * * *